US011846156B2

(12) United States Patent
Holderman et al.

(10) Patent No.: US 11,846,156 B2
(45) Date of Patent: Dec. 19, 2023

(54) PRODUCTION VALVE HAVING WASHPIPE FREE ACTIVATION

(71) Applicant: Halliburton Energy Services, Inc., Houston, TX (US)

(72) Inventors: Luke Holderman, Singapore (SG); Ibrahim El Mallawany, Dhahran (SA); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 141 days.

(21) Appl. No.: 17/127,168

(22) Filed: Dec. 18, 2020

(65) Prior Publication Data

US 2022/0195839 A1 Jun. 23, 2022

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01); *E21B 2200/06* (2020.05)

(58) Field of Classification Search
CPC ..... E21B 34/08; E21B 43/12; E21B 2200/06; E21B 34/10; E21B 34/00; E21B 33/00
See application file for complete search history.

(56) References Cited

U.S. PATENT DOCUMENTS

| | | | | |
|---|---|---|---|---|
| 7,237,611 | B2 | 7/2007 | Vincent et al. | |
| 9,546,537 | B2 * | 1/2017 | Greci | E21B 43/08 |
| 9,593,553 | B2 * | 3/2017 | Larisey | E21B 43/26 |
| 10,030,477 | B2 * | 7/2018 | Hornsby | E21B 34/12 |
| 2013/0161017 | A1 | 6/2013 | King | |

FOREIGN PATENT DOCUMENTS

| | | | |
|---|---|---|---|
| WO | 2009073391 | A2 | 6/2009 |
| WO | 2011119728 | A2 | 9/2011 |

* cited by examiner

*Primary Examiner* — Caroline N Butcher
(74) *Attorney, Agent, or Firm* — Scott Richardson; Parker Justiss, P.C.

(57) ABSTRACT

Disclosed herein are embodiments of a production valve. In one embodiment, a production valve includes a tubular having one or more first openings therein; a sliding member positioned within the tubular and having one or more second openings therein, configured to move between a first closed position wherein the first openings are offset from the second openings to close a fluid path and a second open position wherein the first openings are aligned with the second openings to open the fluid path; a remote open member positioned within the tubular, coupled to the sliding member in the first position and decoupled from the sliding member in the second position; and a first and second seal positioned between the tubular and at least one of the sliding member or remote open member, the first seal having a first seal area, and the second seal having a second greater seal area.

20 Claims, 11 Drawing Sheets

PRODUCTION VALVE HAVING WASHPIPE FREE ACTIVATION

BACKGROUND

In hydrocarbon production wells, it may be beneficial to regulate the flow of formation fluids from a subterranean formation into a wellbore penetrating the same. A variety of reasons or purposes may necessitate such regulation including, for example, prevention of water and/or gas coning, minimizing water and/or gas production, minimizing sand production, maximizing oil production, balancing production from various subterranean zones, and equalizing pressure among various subterranean zones, among others.

A number of devices and valves are available for regulating the flow of formation fluids. Some of these devices may be non-discriminating for different types of formation fluids and may simply function as a "gatekeeper" for regulating access to the interior of a wellbore pipe, such as a production string. Such gatekeeper devices may be simple on/off valves or they may be metered to regulate fluid flow over a continuum of flow rates. Other types of devices for regulating the flow of formation fluids may achieve at least some degree of discrimination between different types of formation fluids. Such devices may include, for example, tubular flow restrictors, nozzle-type flow restrictors, autonomous inflow control devices, non-autonomous inflow control devices, ports, tortuous paths, and combinations thereof.

BRIEF DESCRIPTION

Reference is now made to the following descriptions taken in conjunction with the accompanying drawings, in which.

DETAILED DESCRIPTION

Figure 1:
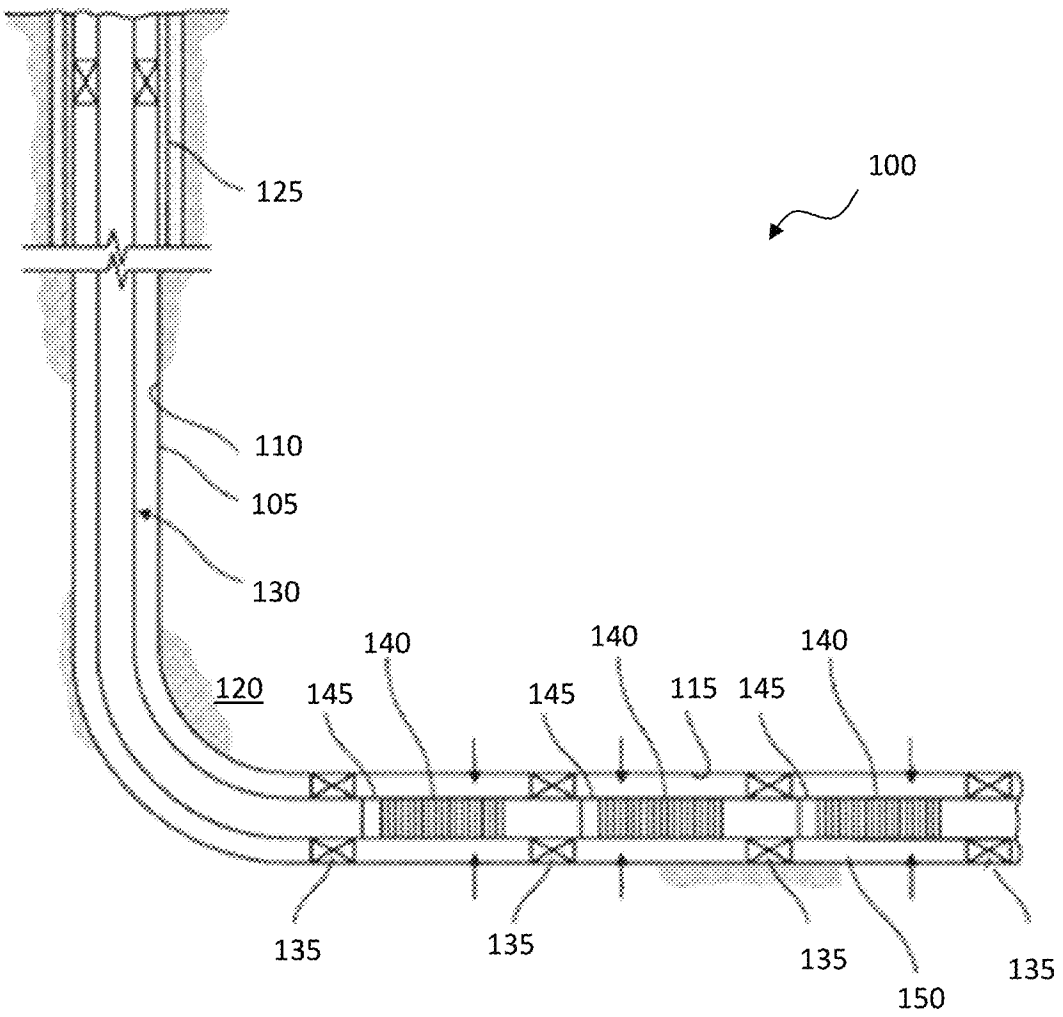
FIG. 1 illustrates a schematic view of a well system designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

FIG. 1 illustrates a schematic view of a well system designed, manufactured and operated according to one or more embodiments of the disclosure. The well system 100 may include a wellbore 105 that comprises a generally vertical uncased section 110 that may transition into a generally horizontal uncased section 115 extending through a subterranean formation 120. In some examples, the vertical section 110 may extend downwardly from a portion of wellbore 105 having a string of casing 125 cemented therein. A tubular string, such as production tubing 130, may be installed in or otherwise extended into wellbore 105.

In the illustrated embodiment, one or more production packers 135, well screens 140, and production valves 145 may be interconnected along the production tubing 130. In most systems, there are at least two sets of production packers 135, well screens 140, and production valves 145 interconnected along the production tubing 130. The production packers 135 may be configured to seal off an annulus 150 defined between the production tubing 130 and the walls of wellbore 105. As a result, fluids may be produced from multiple intervals of the surrounding subterranean formation 120, in some embodiments via isolated portions of annulus 150 between adjacent pairs of production packers 135. The well screens 140 may be configured to filter fluids flowing into production tubing 130 from annulus 150.

Each of the one or more production valves 145, in one or more embodiments, may include a tubular having one or more first openings therein, as well as a sliding member positioned at least partially within the tubular and having one or more second openings therein. In accordance with one or more embodiments, the sliding member is configured to move between a first closed position wherein the one or more second openings are offset from the one or more first openings to close a fluid path, and a second open position wherein the one or more second openings are aligned with the one or more first openings to open the fluid path. The one or more production valves 145, in at least one other embodiment, may include a remote open member positioned at least partially within the tubular. The remote open member, in this embodiment, is configured to be coupled to the sliding member when the sliding member is in the first position and decoupled from the sliding member when the sliding member is in the second position. The one or more production valves 145, in accordance with the disclosure, may additionally include a first seal positioned between the tubular and at least one of the sliding member or remote open member, the first seal having a first seal area, and a second seal positioned between the tubular and at least one of the sliding member or the remote open member, the second seal having a second greater seal area.

In at least one embodiment, the production packers 135 are configured to deploy at a lower pressure than the production valves 145. For instance, the well system 100 could be subjected to a first lower pressure to deploy the production packers 135, and then be subjected to a second greater activation pressure to deploy (e.g., open) the production valves 145. In at least one embodiment, the production packers 135 deploy in a zipper like manner, or one right after the other, for example from heel to toe in the wellbore 105. Similarly, in at least one embodiment the production valves 145 trigger in a zipper like manner, for example with the shear pins of the production valves 145 shearing or one right after the other (e.g., from heel to toe in the wellbore 105). The production valves 145 would thus remain within the triggered, but not opened state, until the pressure within the production valves 145 is bled below a threshold value, at which point spring features within the production valves 145 overpower the piston area/pressure and the production valves 145 move to the opened state.

Figure 2:
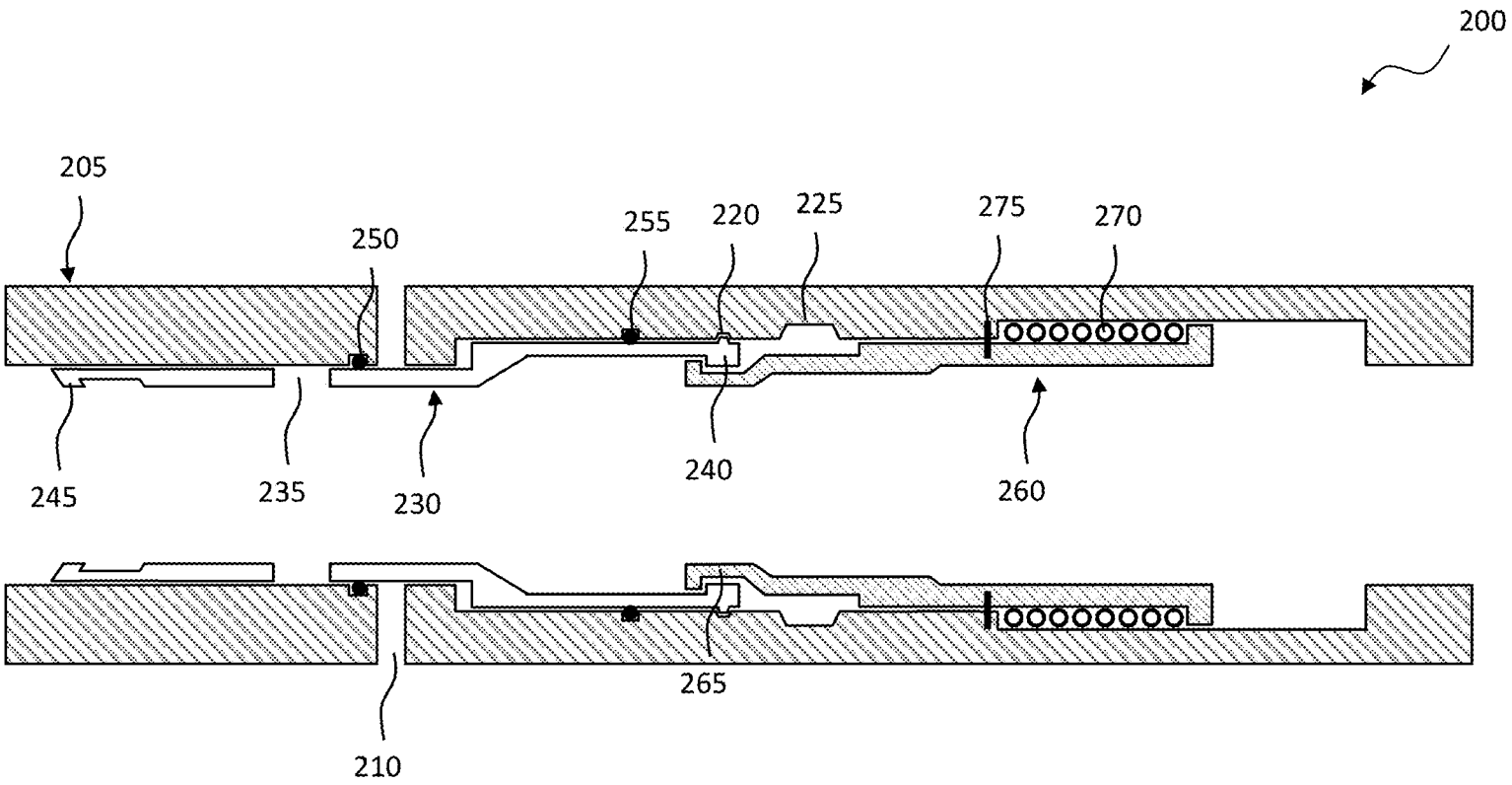
FIG. 2 illustrates a production valve designed, manufactured and operated according to one or more embodiments of the disclosure.
Figure 3A:
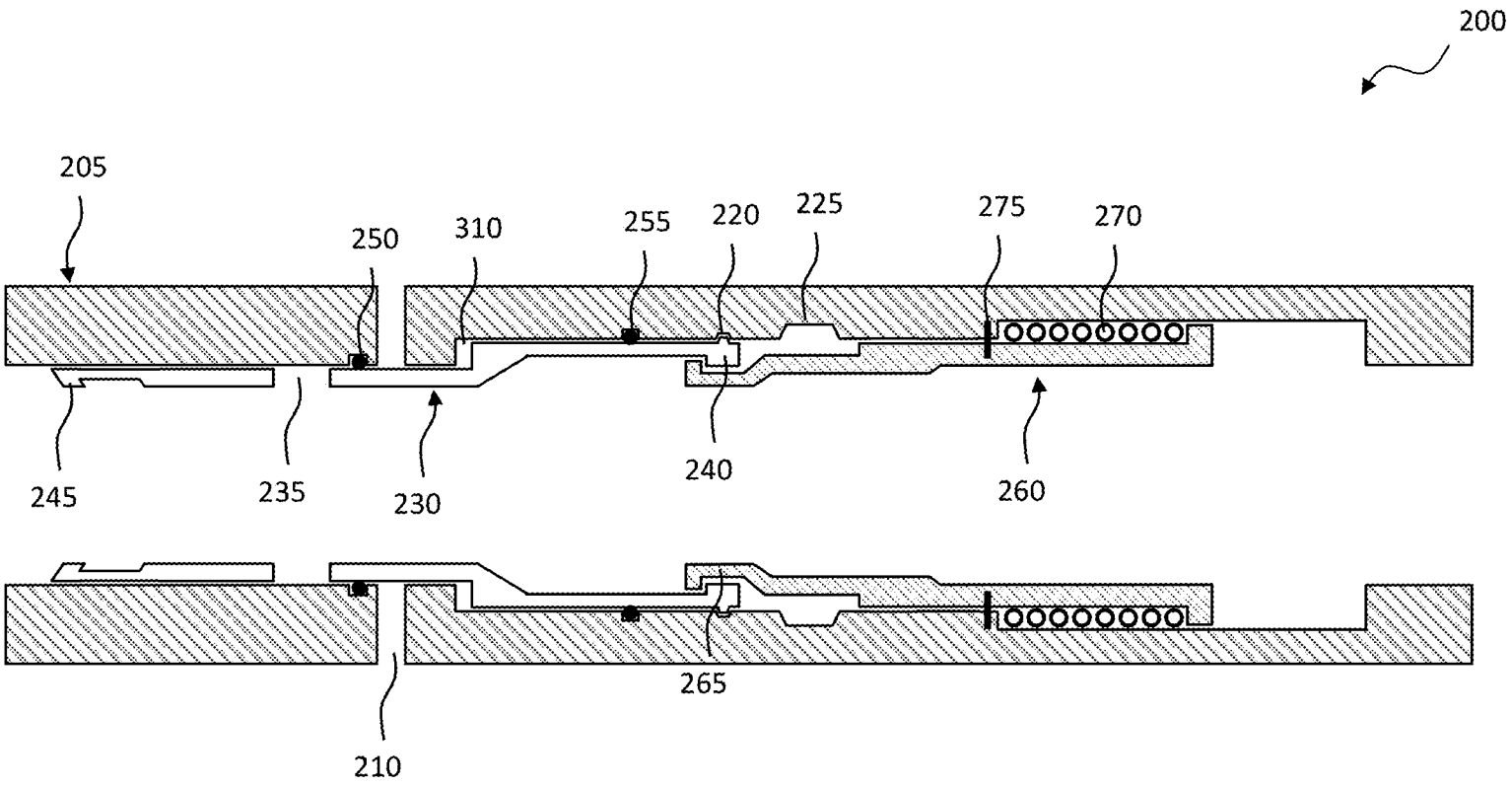
FIGS. 3A through 3D illustrate one embodiment of a method for activating the production valve illustrated in FIG. 2.

Turning to FIG. 2, illustrate a production valve 200 designed, manufactured and operated according to one or more embodiments of the disclosure. The production valve 200 may include a tubular 205 having one or more first openings 210 therein. The tubular 205, in at least one embodiment, is a steel tubular. The production valve 200, in the illustrated embodiment, may further include a sliding member 230 positioned at least partially within the tubular 205. The sliding member 230, in at least one embodiment, may have one or more second openings 235 therein. The sliding member 230 may be configured to move between a first closed position (e.g., as shown in FIG. 3A) and a second open position (e.g., as shown in FIG. 3D). In the first closed position, the one or more second openings 235 may be offset from the one or more first openings 210 to close a fluid path between the wellbore and an inner diameter of the tubular 205. In the second open position, the one or more second openings 235 may be aligned with the one or more first openings 210 to open the fluid path. In at least one embodiment, the sliding member 230 may be a sliding production sleeve.

The sliding member 230, in at least one embodiment, includes a sliding member collet 240 located proximate an end thereof. In the illustrated embodiment, the sliding member collet 240 is located proximate a downhole end of the sliding member 230. The sliding member collet 240, in at least one embodiment, is configured to engage with a first tubular collet profile 220 in the tubular 205 when the sliding member 230 is in the first closed position, and engage (e.g., extend radially outward into) a second larger tubular collet profile 225 in the tubular 205 when the sliding member 230 is in the second open position.

In at least one other embodiment, the sliding member 230 additionally includes a shifting profile 245 located proximate the opposite end thereof. In the illustrated embodiment, the shifting profile 245 is located proximate an uphole end of the sliding member 230, and for example on a radially interior surface of the sliding member 230. The shifting profile 245, in certain embodiments, may be used to return the sliding member 230 to the first closed position after the production valve 200 has been triggered. In one embodiment, an intervention tool (e.g., coiled tubing, wireline, etc.) could be run-in-hole to engage the shifting profile 245, and thus return the sliding member 230 to the first closed position.

The production valve 200, in some embodiments, further includes a first seal 250 positioned between the tubular 205 and the sliding member 230. In at least one embodiment, the first seal 250 has a first seal area. The production valve 200, in at least some other embodiments, further includes a second seal 255 positioned between the tubular 205 and the sliding member 230. In accordance with one embodiment of the disclosure, the second seal 255 has a second greater seal area. In some embodiments, the first and second seals 250, 255 may serve to provide a pressure differential across the sliding member 230. In some embodiments, the first and second seals 250, 255 are located on opposing sides of the one or more first openings 210. Accordingly, when an activation pressure is applied against the first and second seals 250, 255, the second greater seal area would cause the sliding member 230 to move in a direction opposite the pressure being applied against the second seal 255. Thus, in the embodiment of FIG. 2, the activation pressure would cause the sliding member 230 to move to the left, or uphole. Nevertheless, other embodiments may exist wherein the opposite is true.

The production valve 200, in the embodiment of FIG. 2, additionally includes a remote open member 260 positioned at least partially within the tubular 205. In some embodiments the remote open member 260 may be configured to be coupled to the sliding member 230 when the sliding member 230 is in the first closed position, and decoupled from the sliding member 230 when the sliding member 230 is in the second open position. In the illustrated embodiment of FIG. 2, the remote open member 260 includes a remote open member collet profile 265 at an end thereof. The remote open member collet profile 265, in the illustrated embodiment, is located at an uphole end of the remote open member 260, and in this embodiment is configured to releasable engage the sliding member collet 240 on the sliding member 230. Accordingly, the remote open member collet profile 265 remains engaged with the sliding member collet 240 when the sliding member 230 is in the first closed position, but when the sliding member 230 moves to the second open position and the sliding member collet 240 falls into the second larger tubular collet profile 225, the sliding member collet 240 disengages with the remote open member collet profile 265, and thus decouples the remote open member 260 from the sliding member 230.

The production valve 200 may additionally include a spring feature 270 coupled between the remote open member 260 and the tubular 205. The spring feature 270 may be configured to urge the remote open member 260 in a direction opposite the direction that the pressure on the second greater seal area would move the sliding member 230. In the illustrated embodiment of FIG. 2, the spring feature 270 urges the remote open member 260 to the right, or downhole. In one or more embodiments, the spring feature 270 may be a spring, or in other embodiments may be an air pocket, chamber, or gas spring configured to provide a hydrostatic spring force.

The production valve 200 may additionally include a shear feature 275 fixing the remote open member 260 relative to the tubular 205. In some embodiments, the shear feature 275 may be configured to shear when the second seal 255 having the second greater seal area is subjected to an amount of pressure sufficient to overcome a shear force of the shear feature 275. In the embodiment of FIG. 2, the shear feature 275 would desirably shear when the production valve 200 is subjected to the activation pressure, but would not shear when the production valve 200 is subjected to lower pressures, such as certain lower pressures used to configure the well. For example, in one embodiment the shear feature 275 would shear when the production valve 200 is subjected to the activation pressure, but would not shear when the production valve 200 is subjected to lower pressures needed to set one or more production packers within the well. Those skilled in the art understand how exactly to set the appropriate shear force for the shear feature 275. The shear feature 275, in at least one embodiment, is a shear pin.

Figure 3B:
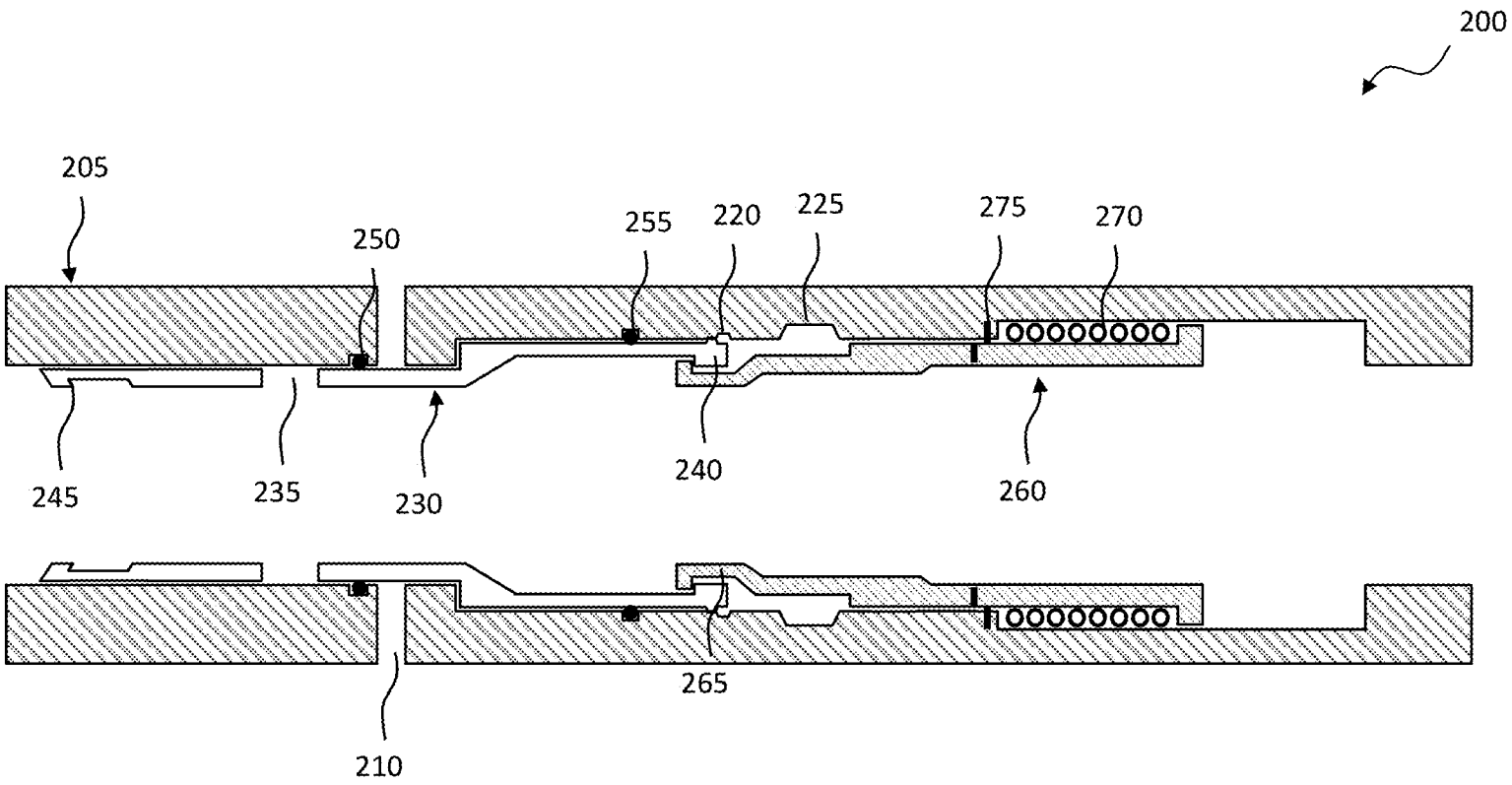
Figure 3C:
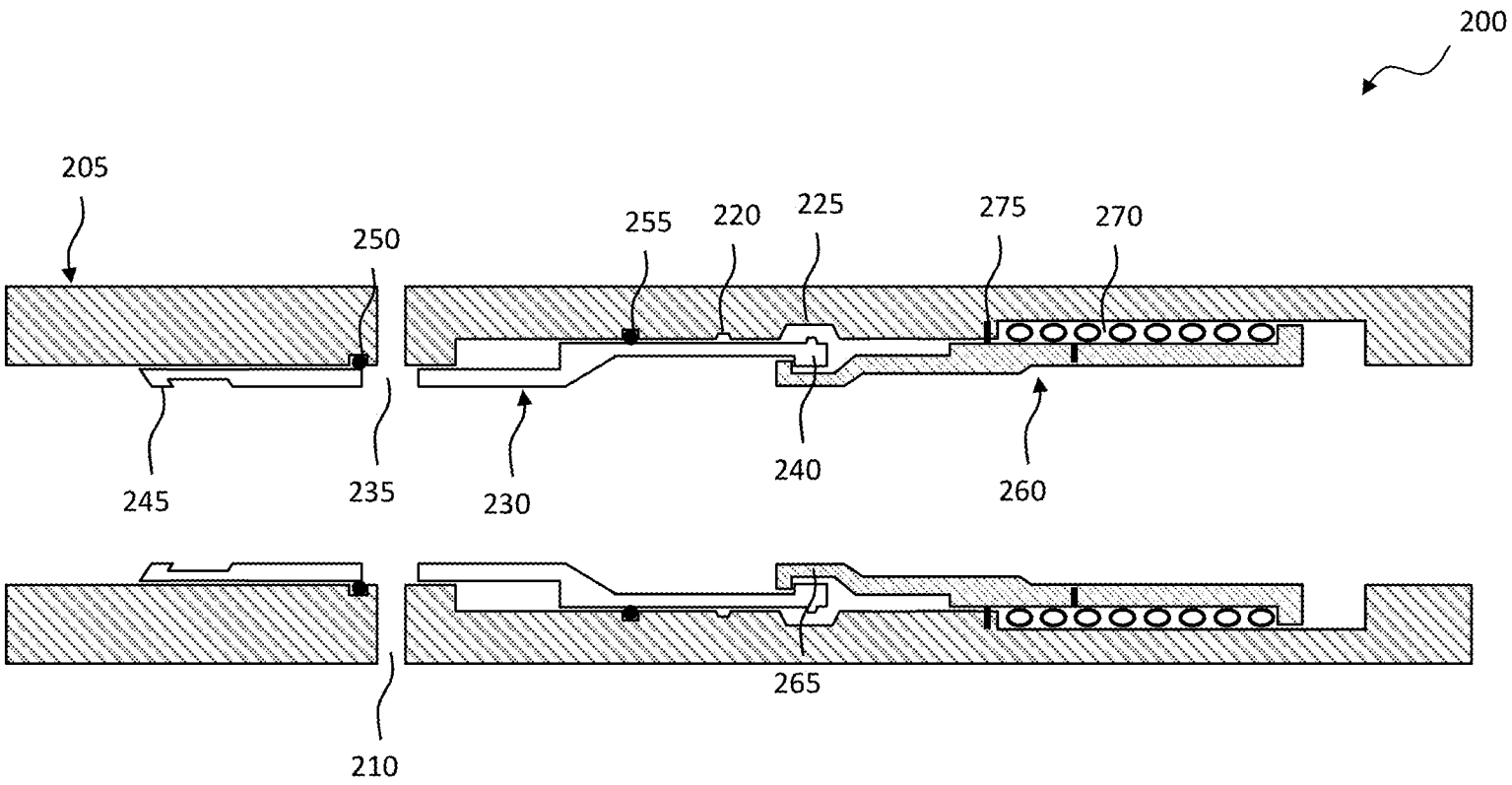
Figure 3D:
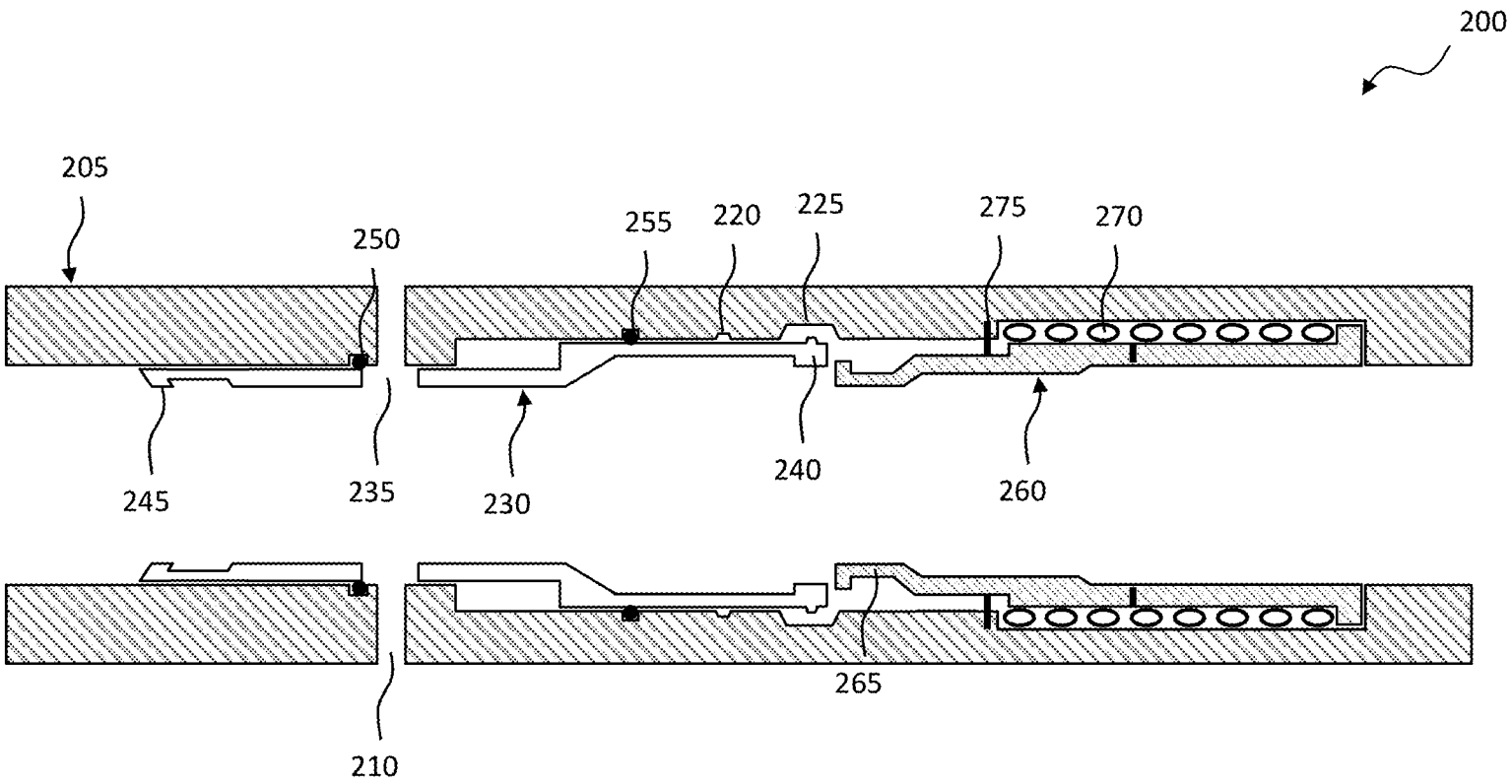

With reference to FIGS. 3A through 3D, illustrated is one embodiment of a method for activating the production valve 200 illustrated in FIG. 2. FIG. 3A illustrates the production valve 200 in the run-in-hole position, FIG. 3B illustrates the production valve 200 in the triggered, but closed position, FIG. 3C illustrates the production valve 200 in the open position, but with the remote open member 260 still engaged with the sliding member 230, and FIG. 3D illustrates the production valve 200 in the open position, and with the remote open member 260 disengaged from the sliding member 230.

Turning to FIG. 3A, illustrated is the production valve 200 with the sliding member 230 in the run-in-hole, and thus closed position. Furthermore, the sliding member collet 240 is engaged with the first tubular collet profile 220. Additionally, the sliding member collet 240 is engaged with the remote open member collet profile 265. Furthermore, the shear feature 275 is fixing the remote open member 260 relative to the tubular 205, and thus is keeping the spring feature 270 in a semi-compressed state. At this stage, a gap 310 exists between the sliding member 230 and the tubular 205, and the production valve has yet to be triggered.

Turning to FIG. 3B, illustrated is the production valve 200 of FIG. 3A after subjecting it to an activation pressure. The activation pressure, in the illustrated embodiment, acts upon the second greater seal area of the second seal 255, and thus urges the sliding member to the left, or uphole in the embodiment of FIG. 3B. When the activation pressure eclipses the shear force on the shear feature 275, the shear feature 275 shears, and thus the sliding member 230 moves to the left, thereby closing the gap 310 between the sliding member 230 and the tubular 205. Accordingly, the activation pressure further compresses the spring feature 270. At this stage, the sliding member 230 remains in the first closed position, as the activation pressure acting upon the second greater seal area is larger than the spring force acting upon the remote open member 260. Accordingly, the production valve 200 has been triggered, but remains within the closed position.

Turning to FIG. 3C, illustrated is the production valve 200 of FIG. 3B after reducing the pressure within the tubular 205, for example to a value such that the pressure acting upon the second greater seal area is less than the spring force acting upon the remote open member 260. At this stage, the spring force overcomes the pressure acting on the second greater seal area, and thus the spring feature 270 urges the remote open member 260 (e.g., and thus the sliding member 230 by way of the sliding member collet 240 and remote open member collet profile 265) to the right, or downhole. Accordingly, the sliding member 230 moves from the first closed position to the second open position. Moreover, the one or more second openings 235 are aligned with the one or more first openings 210, and thus the fluid path is open.

Turning to FIG. 3D, illustrated is the production valve 200 of FIG. 3C after the sliding member collet 240 engages with (e.g., radially extends out into) the second larger tubular collet profile 225, thereby releasing the remote open member collet profile 265 from the sliding member collet 240. Accordingly, the spring feature 270 further urges the remote open member 260 to the right, or downhole, and thus disengages the remote open member 260 from the sliding member 230. At this stage, the production valve 200 is ready to produce fluids from the surrounding formation. If it is desired to close the production valve 200 at a later time, an intervention tool could be run downhole to the production valve 200, wherein the intervention tool could engage with the shifting profile 245 and return the sliding member 230 back to the first closed position.

Figure 4:
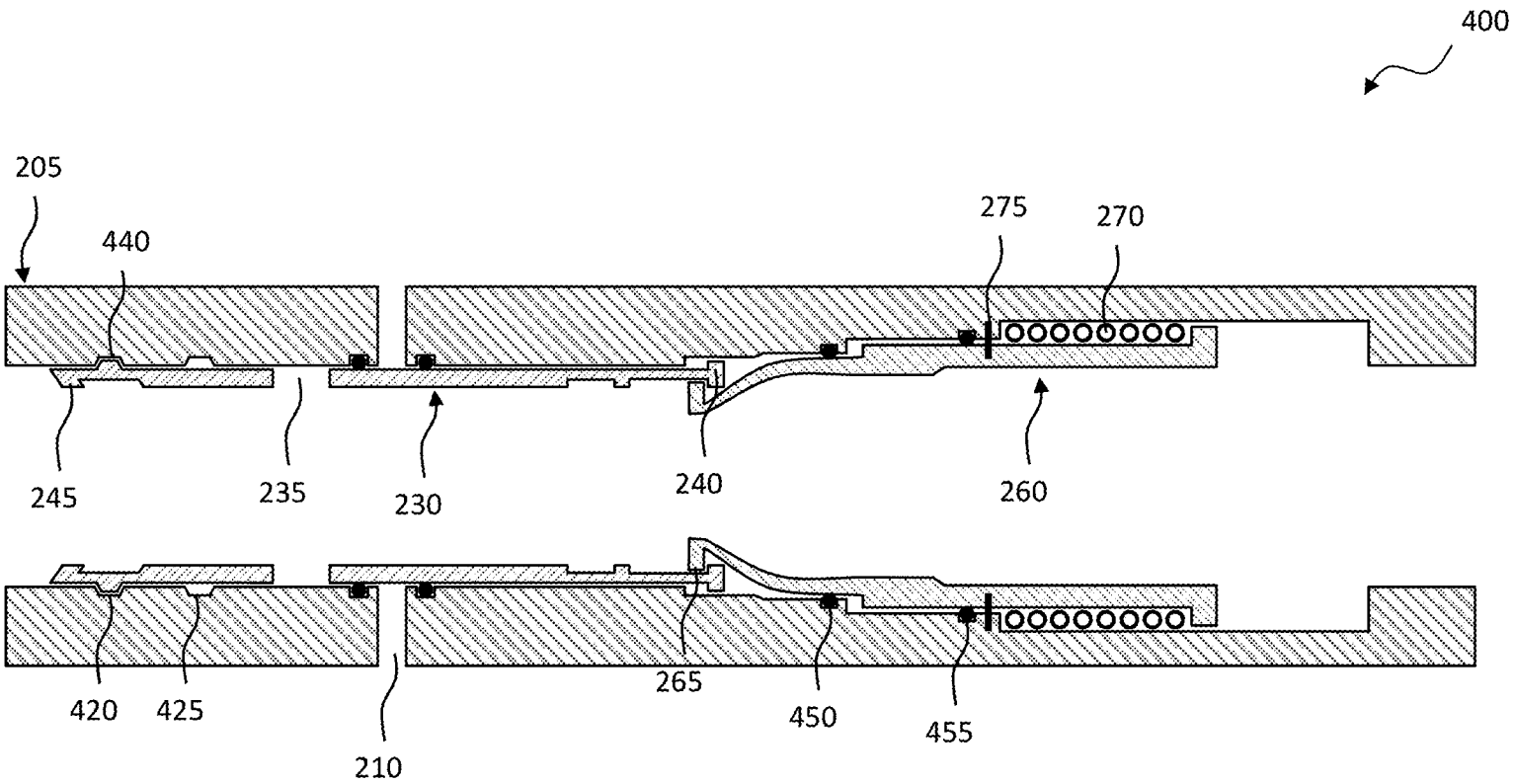
FIG. 4 illustrates a production valve designed, manufactured and operated according to one or more alternative embodiments of the disclosure.

Turning to FIG. 4, illustrate a production valve 400 designed, manufactured and operated according to one or more alternative embodiments of the disclosure. The production valve 400 of FIG. 4 is similar in many respect to the production valve 200 of FIG. 2. Accordingly, like reference number have been used to indicate similar, if not identical, features. The production valve 400 of FIG. 4 differs, for the most part, from the production valve 200 of FIG. 2, in that the production valve 400 places its first seal 450 having the first seal area and its second seal 455 having the second greater seal area between the remote open member 260 and the tubular 205.

Thus, in some embodiments, the first and second seals 450, 455 may serve to provide a pressure differential across the remote open member 260. Accordingly, when an activation pressure is applied against the first and second seals 450, 455, the second greater seal area would cause the remote open member 260 to move in a direction opposite the pressure being applied against the second seal 455. Thus, in the embodiment of FIG. 4, the activation pressure would cause the remote open member 260 to move to the left, or uphole. Nevertheless, other embodiments may exist wherein the opposite is true.

Further to the embodiment of FIG. 4, the sliding member 230, in at least one embodiment, includes a sliding member collet 440 located proximate an end thereof. In the illustrated embodiment, the sliding member collet 440 is located proximate an uphole end of the sliding member 230, and for example on a radially outer surface thereof. The sliding member collet 440, in at least one embodiment, is configured to engage with a first tubular collet profile 420 in the tubular 205 when the sliding member 230 is in the first closed position, and engage a second tubular collet profile 425 in the tubular 205 when the sliding member 230 is in the second open position.

Figure 5A:
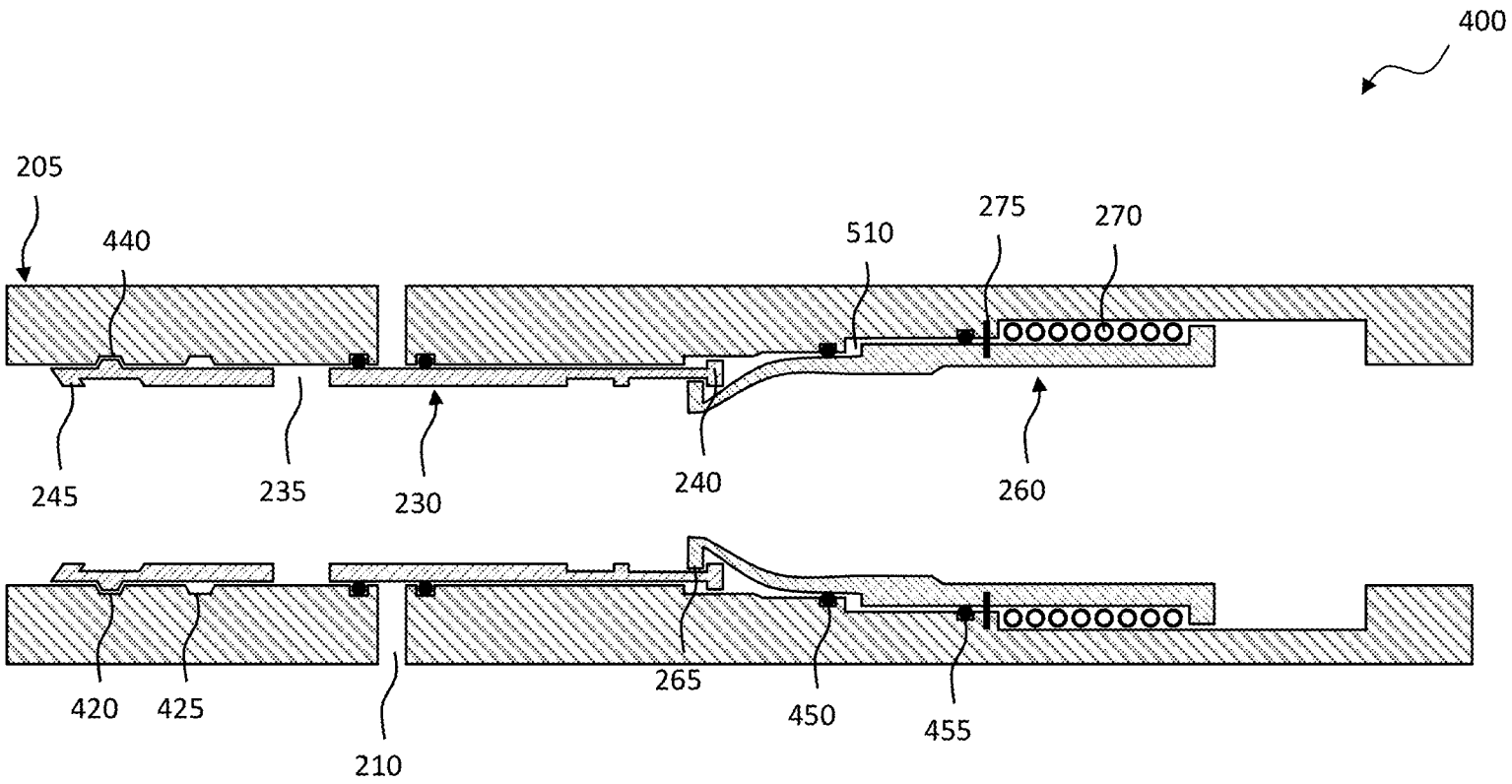
FIGS. 5A through 5D illustrate one embodiment of a method for activating the production valve illustrated in FIG. 4.
Figure 5B:
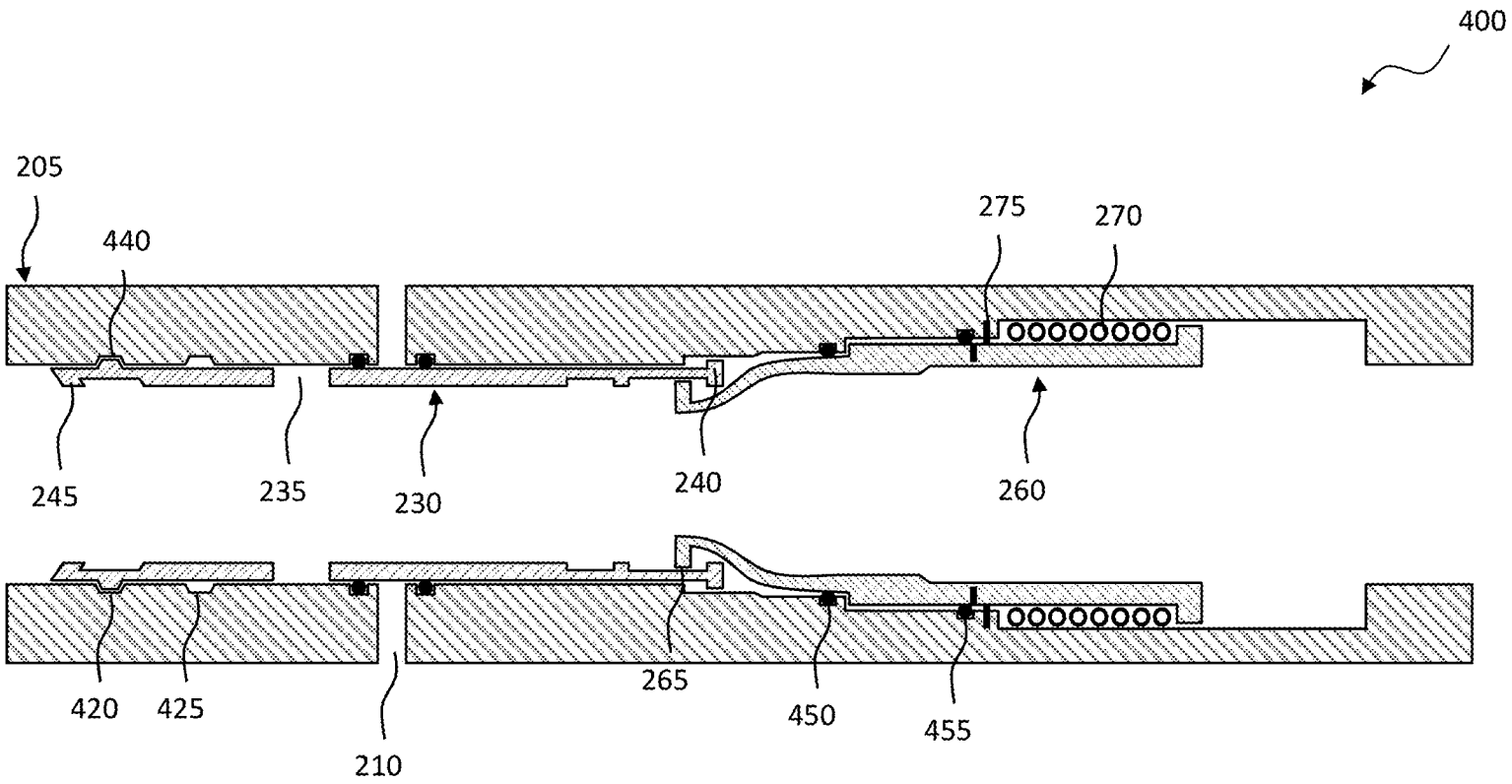
Figure 5C:
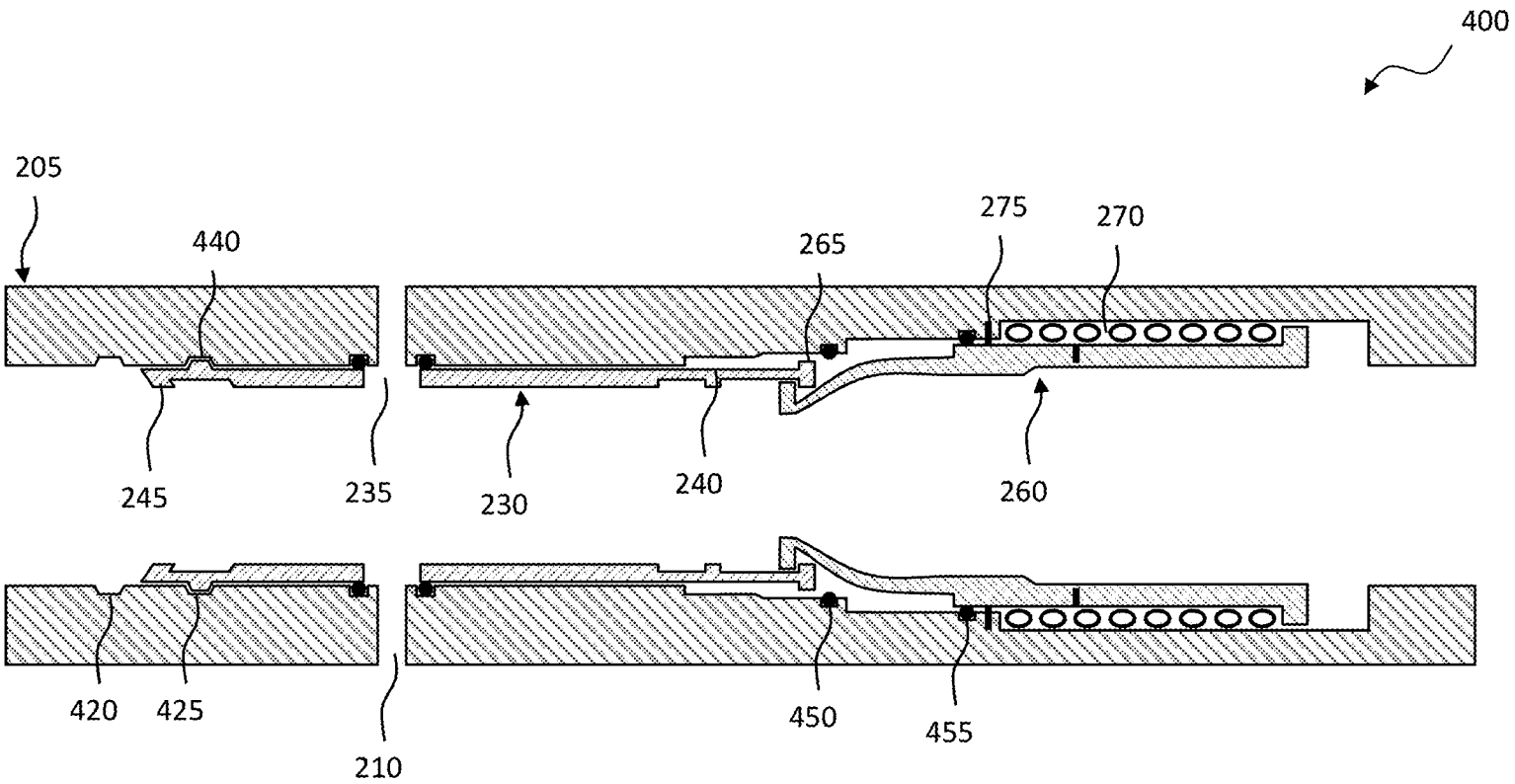
Figure 5D:
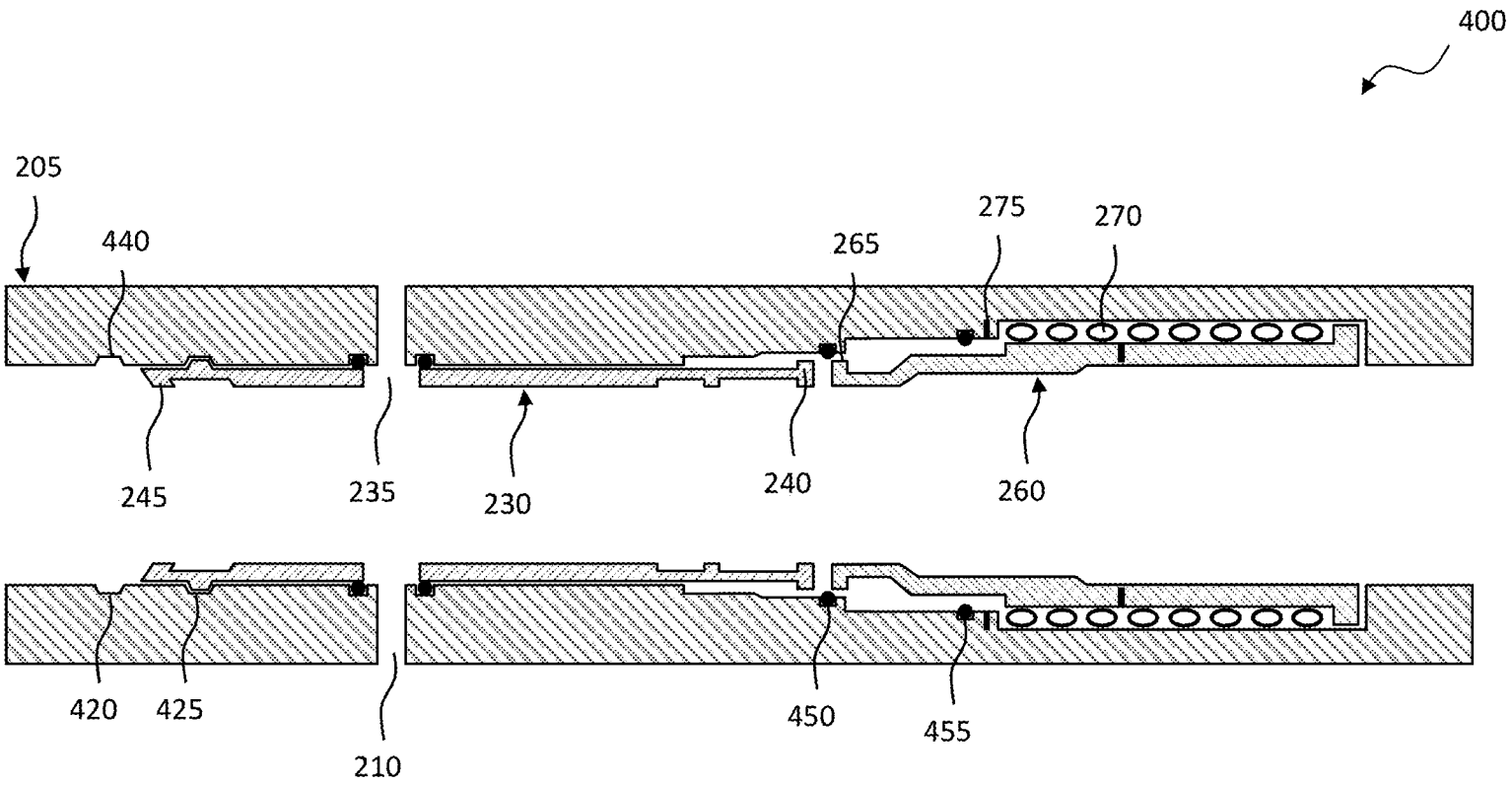

With reference to FIGS. 5A through 5D, illustrated is one embodiment of a method for activating the production valve 400 illustrated in FIG. 4. FIG. 5A illustrates the production valve 400 in the run-in-hole position, FIG. 5B illustrates the production valve 400 in the triggered, but closed position, FIG. 5C illustrates the production valve 400 in the open position, but with the remote open member 260 still engaged with the sliding member 230, and FIG. 5D illustrates the production valve 400 in the open position, and with the remote open member 260 disengaged from the sliding member 230.

Turning to FIG. 5A, illustrated is the production valve 400 with the sliding member 230 in the run-in-hole, and thus closed position. Furthermore, the sliding member collet 440 is engaged with the first tubular collet profile 420. Additionally, the sliding member collet 240 is engaged with the remote open member collet profile 265. Furthermore, the shear feature 275 is fixing the remote open member 260 relative to the tubular 205, and thus is keeping the spring feature 270 in a semi-compressed state. At this stage, a gap 510 exists between the remote open member 260 and the tubular 205, and the production valve has yet to be triggered.

Turning to FIG. 5B, illustrated is the production valve 400 of FIG. 5A after subjecting it to an activation pressure. The activation pressure, in the illustrated embodiment, acts upon the second greater seal area of the second seal 455, and thus urges the remote open member 260 to the left, or uphole in the embodiment of FIG. 5B. When the activation pressure eclipses the shear force on the shear feature 275, the shear feature 275 shears, and thus the remote open member 260 moves to the left, thereby closing the gap 510 between the remote open member 260 and the tubular 205. Accordingly, the activation pressure further compresses the spring feature 270. At this stage, the sliding member 230 remains in the first closed position. Accordingly, the production valve 400 has been triggered, but remains within the closed position.

Turning to FIG. 5C, illustrated is the production valve 400 of FIG. 5B after reducing the pressure within the tubular 205, for example to a value such that the pressure acting upon the second greater seal area is less than the spring force acting upon the remote open member 260. At this stage, the spring force overcomes the pressure acting on the second greater seal area, and thus the spring feature 270 urges the remote open member 260 (e.g., and thus the sliding member 230 by way of the sliding member collet 240 and remote open member collet profile 265) to the right, or downhole. Accordingly, the sliding member 230 moves from the first closed position to the second open position. Moreover, the one or more second openings 235 are aligned with the one or more first openings 210, and thus the fluid path is open.

Turning to FIG. 5D, illustrated is the production valve 400 of FIG. 5C after the sliding member collet 440 engages with the second tubular collet profile 425, thereby preventing the sliding member 230 from moving any further to the right. Accordingly, the spring feature 270 further urges the remote open member 260 to the right, or downhole, and thus disengages the remote open member 260 from the sliding member 230. At this stage, the production valve 400 is ready to produce fluids from the surrounding formation. If it is desired to close the production valve 400 at a later time, an intervention tool could be run downhole to the production valve 400, wherein the intervention tool could engage with the shifting profile 245 and return the sliding member 230 back to the first closed position.

Aspects disclosed herein include:

A. A production valve, the production valve including: 1) a tubular having one or more first openings therein; 2) a sliding member positioned at least partially within the tubular and having one or more second openings therein, the sliding member configured to move between a first closed position wherein the one or more second openings are offset from the one or more first openings to close a fluid path and a second open position wherein the one or more second openings are aligned with the one or more first openings to open the fluid path; 3) a remote open member positioned at least partially within the tubular, the remote open member configured to be coupled to the sliding member when the sliding member is in the first position and decoupled from the sliding member when the sliding member is in the second position; 4) a first seal positioned between the tubular and at least one of the sliding member or remote open member, the first seal having a first seal area; and 5) a second seal positioned between the tubular and at least one of the sliding member or the remote open member, the second seal having a second greater seal area.

B. A method for opening a production valve, the method including: 1) placing a production valve into a wellbore, the production valve including: a) a tubular having one or more first openings therein; b) a sliding member positioned at least partially within the tubular and having one or more second openings therein, the sliding member configured to move between a first closed position wherein the one or more second openings are offset from the one or more first openings to close a fluid path and a second open position wherein the one or more second openings are aligned with the one or more first openings to open the fluid path; c) a remote open member positioned at least partially within the tubular, the remote open member configured to be coupled to the sliding member when the sliding member is in the first position and decoupled from the sliding member when the sliding member is in the second position; d) a first seal positioned between the tubular and at least one of the sliding member or remote open member, the first seal having a first seal area; e) a second seal positioned between the tubular and at least one of the sliding member or the remote open member, the second seal having a second greater seal area; and f) a shear feature fixing the remote open member relative to the tubular; and 2) applying a production valve activation pressure to an inner diameter of the tubular and the second greater seal area, the production valve activation pressure sufficient to shear the shear feature; and 3) reducing a pressure within the inner diameter of the tubular, the reducing allowing the sliding member to move from the first closed position to the second open position and the remote open member to decouple from the sliding member.

C. A well system, the well system including: 1) a wellbore; 2) production tubing positioned within the wellbore; and 3) two or more production valves coupled with the production tubing, each production valve having a production valve activation pressure, and including: a) a tubular having one or more first openings therein; b) a sliding member positioned at least partially within the tubular and having one or more second openings therein, the sliding member configured to move between a first closed position wherein the one or more first openings are offset from the one or more second openings to close a fluid path and a second open position wherein the one or more first openings are aligned with the one or more second openings to open the fluid path; c) a remote open member positioned at least partially within the tubular, the remote open member configured to be coupled to the sliding member when the sliding member is in the first position and decoupled from the sliding member when the sliding member is in the second position; d) a first seal positioned between the tubular and at least one of the sliding member or remote open member, the first seal having a first seal area; and e) a second seal positioned between the tubular and at least one of the sliding member or the remote open member, the second seal having a second greater seal area.

Aspects A, B, and C may have one or more of the following additional elements in combination: Element 1: further including a shear feature fixing the remote open member relative to the tubular. Element 2: wherein the shear feature is configured to shear when the second seal having the second greater seal area is subjected to a pressure sufficient to overcome a shear force of the shear feature. Element 3: further including a spring feature coupled between the remote open member and the tubular, the spring feature configured to urge the remote open member in a first direction, and further wherein the pressure is configured to move the remote open member in a second opposite direction to shear the shear feature. Element 4: wherein the first seal is positioned between the tubular and the sliding member. Element 5: wherein the second seal is positioned between the tubular and the sliding member. Element 6: further including a gap positioned between the tubular and the sliding member when the shear feature is fixing the remote open member relative to the tubular, the gap configured to become smaller when the second greater seal area is subjected to the pressure sufficient to overcome the shear force of the shear feature. Element 7: wherein the sliding member has a sliding member collet proximate an end thereof, the sliding member collet configured to engage a first tubular collet profile in the tubular when the sliding member is in the first closed position and engage a second larger tubular collet profile in the tubular when the sliding member is in the second open position. Element 8: wherein the second larger tubular collet profile is configured to allow the remote open member to decouple from the sliding member. Element 9: wherein the first seal is positioned between the tubular and the remote open member. Element 10: wherein the second seal is positioned between the tubular and the remote open member. Element 11: further including a gap positioned between the tubular and the remote open member when the shear feature is fixing the remote open member relative to the tubular, the gap configured to become smaller when the second greater seal area is subjected to the pressure sufficient to overcome the shear force of the shear feature. Element 12: wherein the remote open member has a remote open member collet proximate an end thereof, the remote open member collet configured to engage a sliding member collet profile in the sliding member when the sliding member is in the first closed position and disengage from the sliding member collet profile when the sliding member is in the second open position. Element 13: wherein the sliding member is a sliding production sleeve. Element 14: wherein the first seal is positioned between the tubular and the sliding member, and the second seal is positioned between the tubular and the sliding member, and further including a gap positioned between the tubular and the sliding member when the shear feature is fixing the remote open member relative to the tubular, wherein applying the production valve activation pressure causes the gap to become smaller and shear the shear feature. Element 15: wherein the first seal is positioned between the tubular and the remote open member, and the second seal is positioned between the tubular and the remote open member, and further including a gap positioned between the tubular and the remote open member when the shear feature is fixing the remote open member relative to the tubular, wherein applying the production valve activation pressure causes the gap to become smaller and shear the shear feature. Element 16: further including one or more production packers positioned within the wellbore, the one or more production packers having production packer activation pressures below the production valve activation pressure, and further including subjecting the production packers to the production packer activation pressure prior to the applying the production valve activation pressure. Element 17: further including one or more production packers positioned between each of the two or more production valves, the one or more production packers having production packer activation pressures below the production valve activation pressure.

Those skilled in the art to which this application relates will appreciate that other and further additions, deletions, substitutions, and modifications may be made to the described embodiments.

What is claimed is:

1. A production valve, comprising:

a tubular having one or more first openings therein;

a sliding member positioned at least partially within the tubular and having one or more second openings therein, the sliding member configured to move between a first closed position wherein the one or more second openings are offset from the one or more first openings to close a fluid path and a second open position wherein the one or more second openings are aligned with the one or more first openings to open the fluid path;

a remote open member positioned at least partially within the tubular, the remote open member configured to be coupled to the sliding member when the sliding member is in the first position and decoupled from the sliding member when the sliding member is in the second position;

a spring feature coupled between the remote open member and the tubular;

a first seal positioned between the tubular and at least one of the sliding member or remote open member, the first seal having a first seal area; and a second seal positioned between the tubular and at least one of the sliding member or the remote open member, the second seal having a second greater seal area.

2. The production valve according to claim 1, further including a shear feature fixing the remote open member relative to the tubular.

3. The production valve according to claim 2, wherein the shear feature is configured to shear when the second seal having the second greater seal area is subjected to a pressure sufficient to overcome a shear force of the shear feature.

4. The production valve according to claim 3, wherein the spring feature is configured to urge the remote open member in a first direction, and further wherein the pressure is configured to move the remote open member in a second opposite direction to shear the shear feature.

5. The production valve according to claim 3, wherein the first seal is positioned between the tubular and the sliding member.

6. The production valve according to claim 5, wherein the second seal is positioned between the tubular and the sliding member.

7. The production valve according to claim 6, further including a gap positioned between the tubular and the sliding member when the shear feature is fixing the remote open member relative to the tubular, the gap configured to become smaller when the second greater seal area is subjected to the pressure sufficient to overcome the shear force of the shear feature.

8. The production valve according to claim 7, wherein the sliding member has a sliding member collet proximate an end thereof, the sliding member collet configured to engage a first tubular collet profile in the tubular when the sliding member is in the first closed position and engage a second larger tubular collet profile in the tubular when the sliding member is in the second open position.

9. The production valve according to claim 8, wherein the second larger tubular collet profile is configured to allow the remote open member to decouple from the sliding member.

10. The production valve according to claim 3, wherein the first seal is positioned between the tubular and the remote open member.

11. The production valve according to claim 10, wherein the second seal is positioned between the tubular and the remote open member.

12. The production valve according to claim 11, further including a gap positioned between the tubular and the remote open member when the shear feature is fixing the remote open member relative to the tubular, the gap configured to become smaller when the second greater seal area is subjected to the pressure sufficient to overcome the shear force of the shear feature.

13. The production valve according to claim 12, wherein the remote open member has a remote open member collet proximate an end thereof, the remote open member collet configured to engage a sliding member collet profile in the sliding member when the sliding member is in the first closed position and disengage from the sliding member collet profile when the sliding member is in the second open position.

14. The production valve according to claim 1, wherein the sliding member is a sliding production sleeve.

15. A method for opening a production valve, the method comprising:

placing the production valve into a wellbore, the production valve including:

a tubular having one or more first openings therein;

a sliding member positioned at least partially within the tubular and having one or more second openings therein, the sliding member configured to move between a first closed position wherein the one or more second openings are offset from the one or more first openings to close a fluid path and a second open position wherein the one or more second openings are aligned with the one or more first openings to open the fluid path;

a remote open member positioned at least partially within the tubular, the remote open member configured to be coupled to the sliding member when the sliding member is in the first position and decoupled from the sliding member when the sliding member is in the second position;

a spring feature coupled between the remote open member and the tubular;

a first seal positioned between the tubular and at least one of the sliding member or remote open member, the first seal having a first seal area;

a second seal positioned between the tubular and at least one of the sliding member or the remote open member, the second seal having a second greater seal area; and a shear feature fixing the remote open member relative to the tubular; and applying a production valve activation pressure to an inner diameter of the tubular and the second greater seal area, the production valve activation pressure sufficient to shear the shear feature; and reducing a pressure within the inner diameter of the tubular, the reducing allowing the sliding member to move from the first closed position to the second open position and the remote open member to decouple from the sliding member.

16. The method according to claim 15, wherein the first seal is positioned between the tubular and the sliding member, and the second seal is positioned between the tubular and the sliding member, and further including a gap positioned between the tubular and the sliding member when the shear feature is fixing the remote open member relative to the tubular, wherein applying the production valve activation pressure causes the gap to become smaller and shear the shear feature.

17. The method according to claim 15, wherein the first seal is positioned between the tubular and the remote open member, and the second seal is positioned between the tubular and the remote open member, and further including a gap positioned between the tubular and the remote open member when the shear feature is fixing the remote open member relative to the tubular, wherein applying the production valve activation pressure causes the gap to become smaller and shear the shear feature.

18. The method according to claim 15, further including one or more production packers positioned within the wellbore, the one or more production packers having production packer activation pressures below the production valve activation pressure, and further including subjecting the production packers to the production packer activation pressure prior to the applying the production valve activation pressure.

19. A well system, comprising:

a wellbore;

production tubing positioned within the wellbore; and two or more production valves coupled with the production tubing, each production valve having a production valve activation pressure, and including:

a tubular having one or more first openings therein;

a sliding member positioned at least partially within the tubular and having one or more second openings therein, the sliding member configured to move between a first closed position wherein the one or more first openings are offset from the one or more second openings to close a fluid path and a second open position wherein the one or more first openings are aligned with the one or more second openings to open the fluid path;

a remote open member positioned at least partially within the tubular, the remote open member configured to be coupled to the sliding member when the sliding member is in the first position and decoupled from the sliding member when the sliding member is in the second position;

a spring feature coupled between the remote open member and the tubular;

a first seal positioned between the tubular and at least one of the sliding member or remote open member, the first seal having a first seal area; and a second seal positioned between the tubular and at least one of the sliding member or the remote open member, the second seal having a second greater seal area.

20. The well systems according to claim 19, further including one or more production packers positioned between each of the two or more production valves, the one or more production packers having production packer activation pressures below the production valve activation pressure.

* * * * *